US008362350B2

(12) United States Patent
Kockovic

(10) Patent No.: US 8,362,350 B2
(45) Date of Patent: Jan. 29, 2013

(54) WEARABLE TRIGGER ELECTRONIC PERCUSSION MUSIC SYSTEM

(76) Inventor: Neven Kockovic, Fontenay Aux Roses (FR)

( * ) Notice: Subject to any disclaimer, the term of this patent is extended or adjusted under 35 U.S.C. 154(b) by 8 days.

(21) Appl. No.: 12/959,829

(22) Filed: Dec. 3, 2010

(65) Prior Publication Data

US 2011/0132181 A1 Jun. 9, 2011

Related U.S. Application Data

(60) Provisional application No. 61/267,407, filed on Dec. 7, 2009.

(51) Int. Cl.
*G10H 1/32* (2006.01)
*G10H 3/00* (2006.01)

(52) U.S. Cl. ..... 84/743

(58) Field of Classification Search ..... 84/743
See application file for complete search history.

(56) References Cited

U.S. PATENT DOCUMENTS

| | | | | |
|---|---|---|---|---|
| 4,414,537 | A | 11/1983 | Grimes | |
| 4,613,139 | A | 9/1986 | Robinson | |
| 4,635,516 | A | 1/1987 | Giannini | |
| 4,681,012 | A | 7/1987 | Stelma et al. | |
| 4,700,602 | A | 10/1987 | Bozzio | |
| 4,753,146 | A | 6/1988 | Seiler | |
| 5,119,709 | A | 6/1992 | Suzuki et al. | |
| 5,338,891 | A * | 8/1994 | Masubuchi et al. | 84/600 |
| 5,373,096 | A * | 12/1994 | Suzuki et al. | 84/600 |
| 5,403,972 | A * | 4/1995 | Valentine, Sr. | 84/730 |
| 5,434,350 | A * | 7/1995 | Haney et al. | 84/743 |
| 5,512,703 | A | 4/1996 | Usa | |
| 5,581,484 | A | 12/1996 | Prince | |
| 5,841,052 | A * | 11/1998 | Stanton | 84/600 |
| 5,856,628 | A * | 1/1999 | Noguchi et al. | 84/738 |
| 6,380,923 | B1 * | 4/2002 | Fukumoto et al. | 345/156 |
| 6,734,349 | B1 | 5/2004 | Adams | |
| 6,819,771 | B2 | 11/2004 | Menzies | |
| 7,012,593 | B2 | 3/2006 | Yoon et al. | |
| 7,135,637 | B2 * | 11/2006 | Nishitani et al. | 84/723 |
| 7,381,884 | B1 * | 6/2008 | Atakhanian | 84/723 |
| 7,674,969 | B2 * | 3/2010 | Xu et al. | 84/615 |
| 7,842,879 | B1 * | 11/2010 | Carter | 84/730 |
| 2004/0112204 | A1 * | 6/2004 | Javelle | 84/645 |
| 2007/0272070 | A1 * | 11/2007 | McGinnis, II | 84/378 |
| 2009/0126554 | A1 | 5/2009 | Xu et al. | |

FOREIGN PATENT DOCUMENTS

| | | | |
|---|---|---|---|
| GB | 2221557 | A1 | 7/1990 |
| GB | 2286035 | A1 | 2/1996 |
| GB | 2305714 | A1 | 4/1997 |
| GB | 2320315 | A1 | 6/1998 |
| WO | 8912858 | A1 | 12/1989 |

* cited by examiner

*Primary Examiner* — Jeffrey Donels
(74) *Attorney, Agent, or Firm* — David Pressman

(57) ABSTRACT

A Wearable Trigger Electronic Music System that can simulate any kind of music, anywhere and at any time. For example one can create all the benefits of the percussion instrument, such as a drum kit, without its cost and burden. The same also applies to string, wind, and other types of instruments of any nation, culture, motif, era, age, etc. The system includes constituent components, including sensors, transducers, electronics, music modules, pre-amps, and amplifiers, wired or wireless, with connections for intra- and inter-modules, including final enjoyment by wired or wireless headphones or speakers. Also delineated is the process of creating music for the DIY enthusiast.

10 Claims, 13 Drawing Sheets

100

Figure 1:
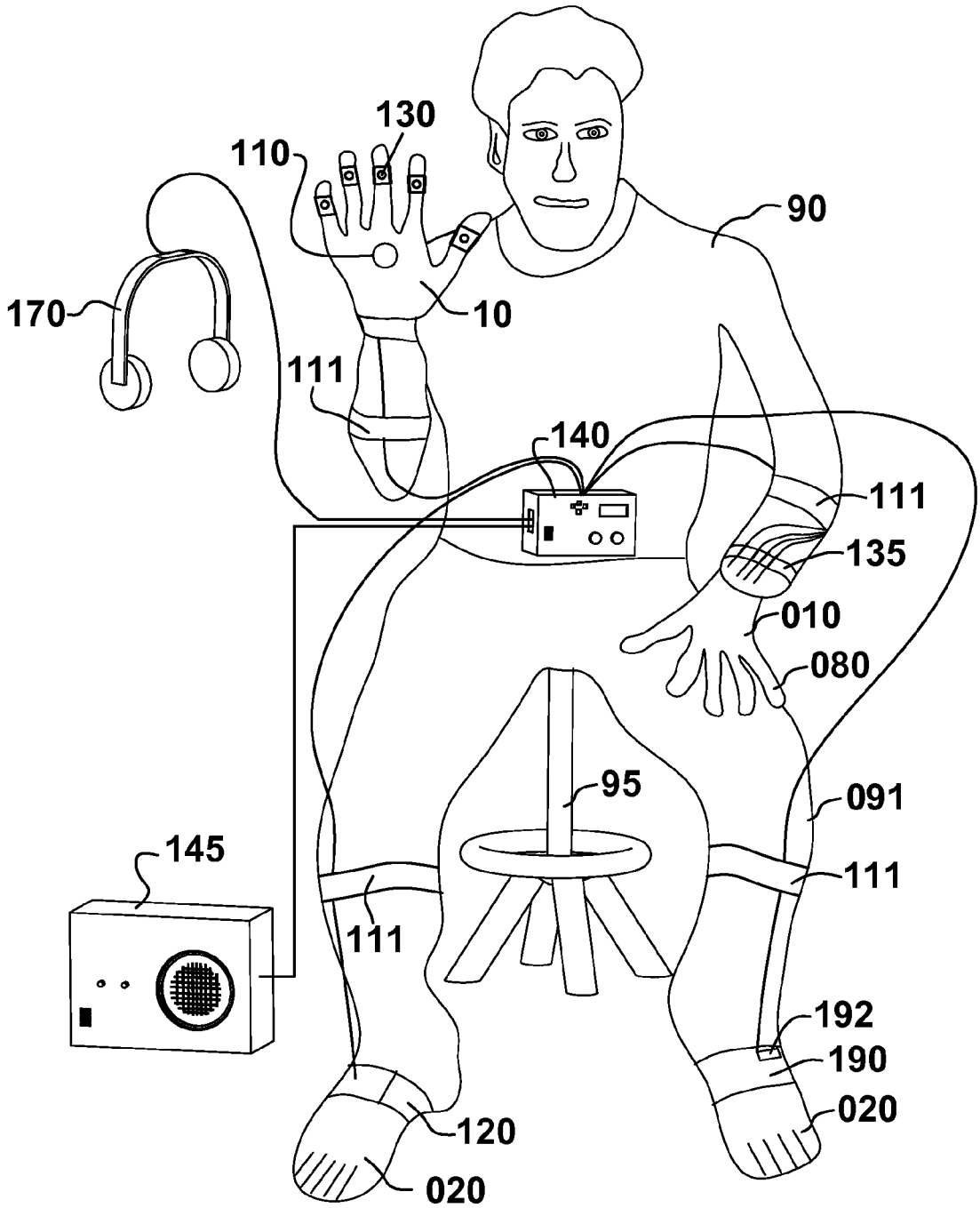

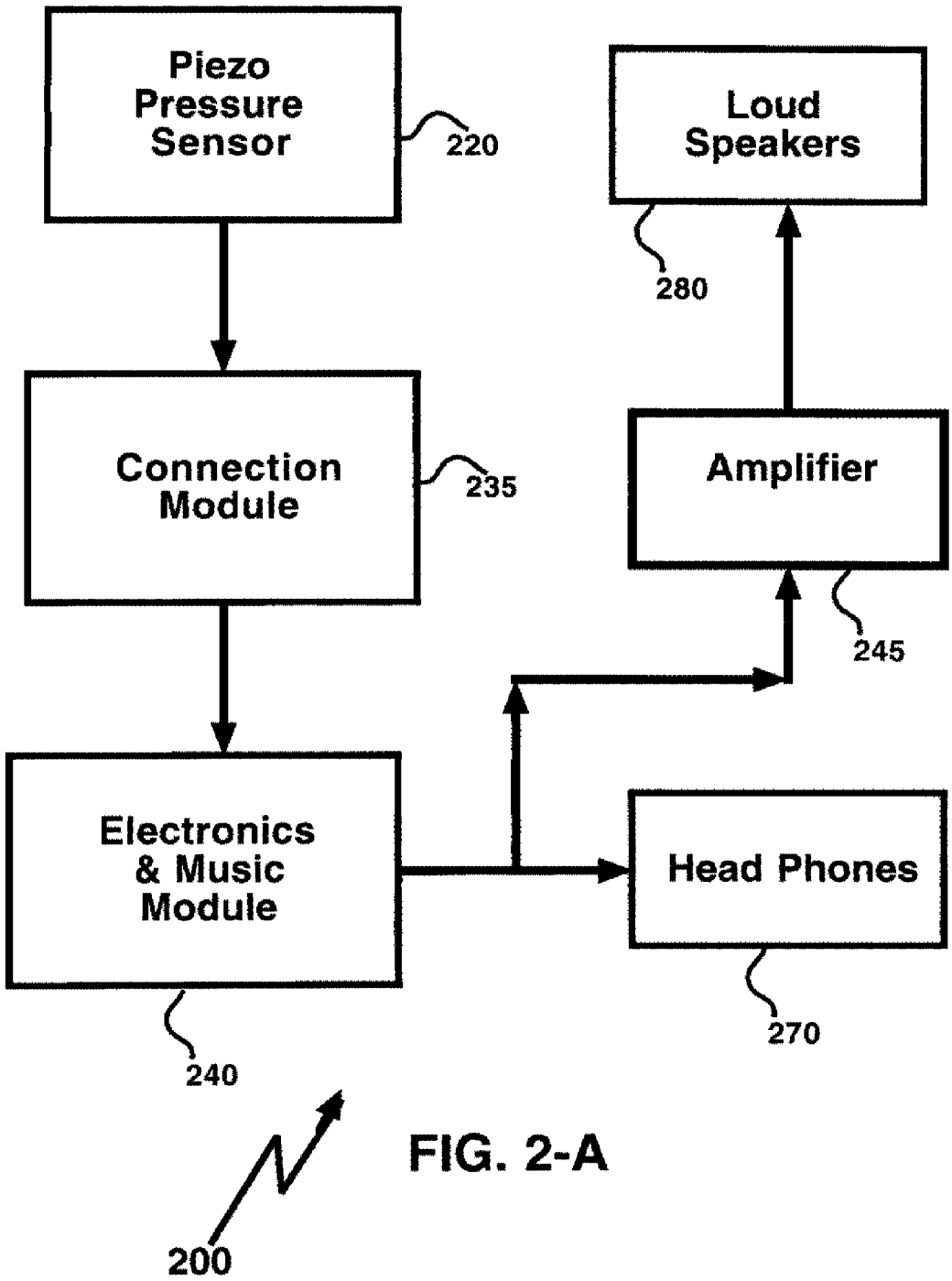
FIG. 2-A

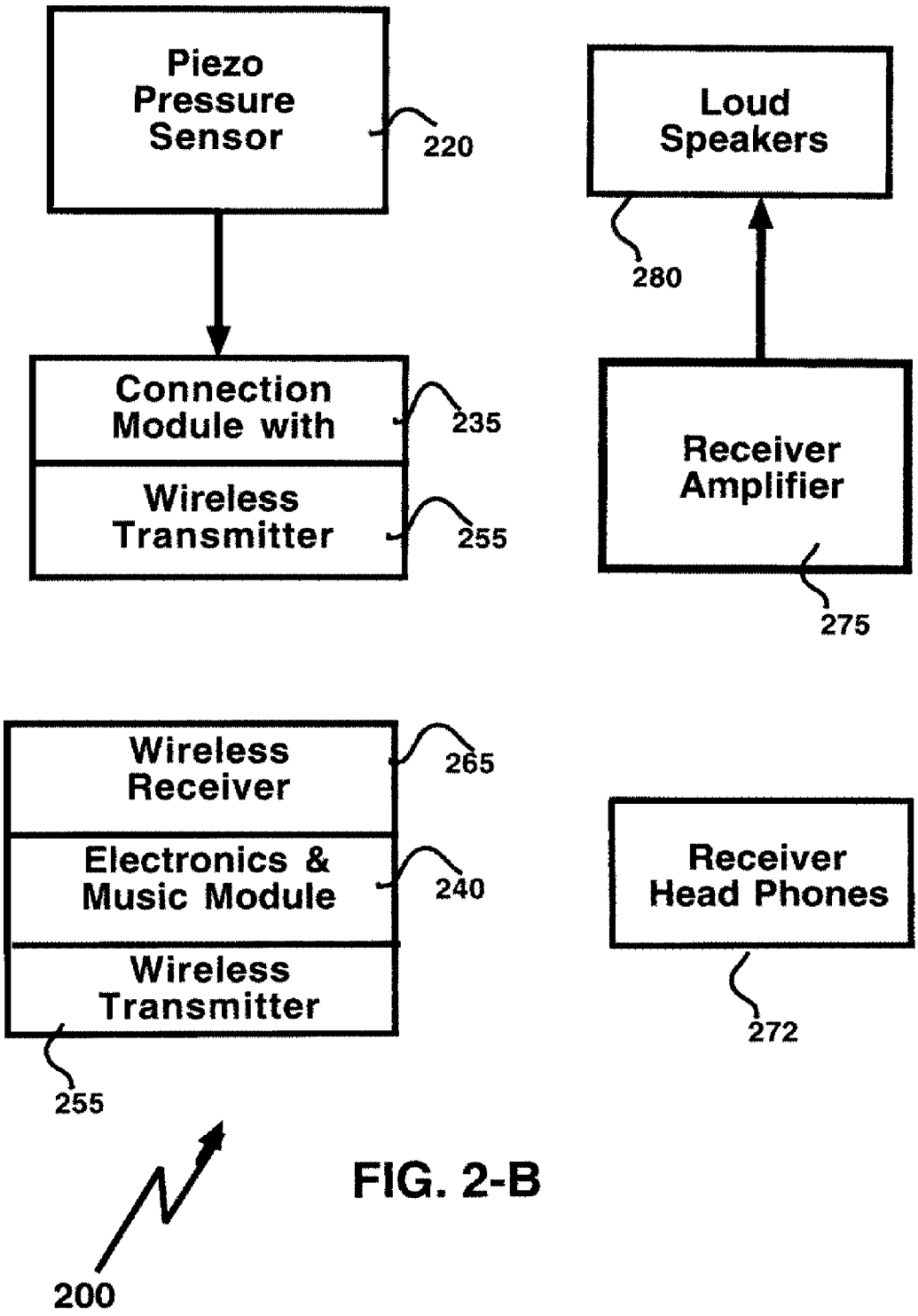
FIG. 2-B

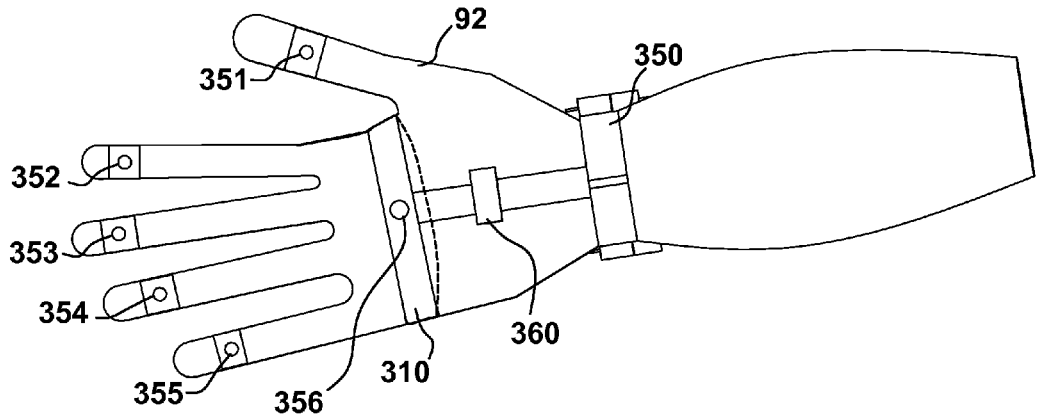
FIG. 3-A
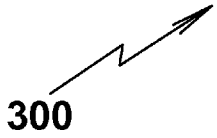

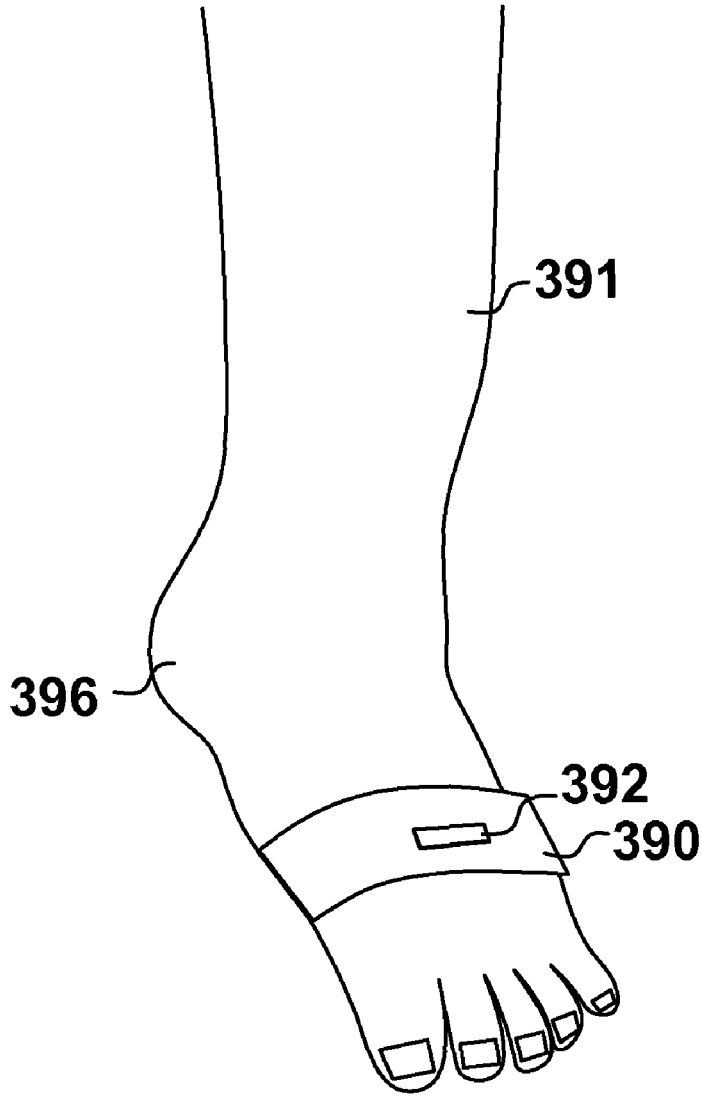
FIG. 3-B
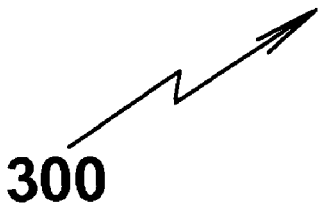

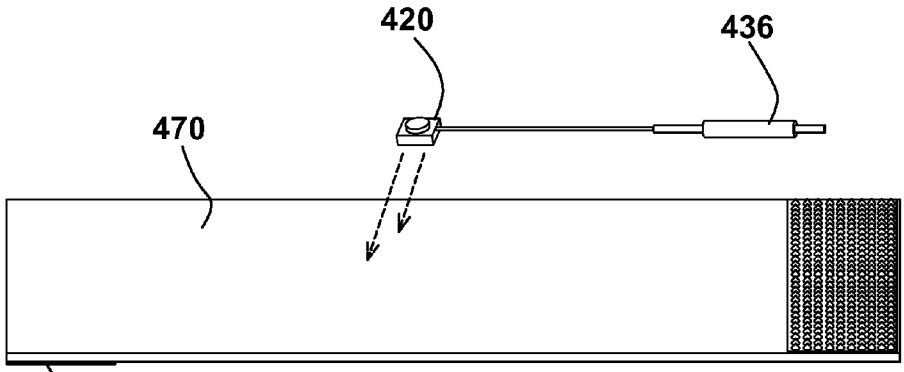
FIG. 4-A
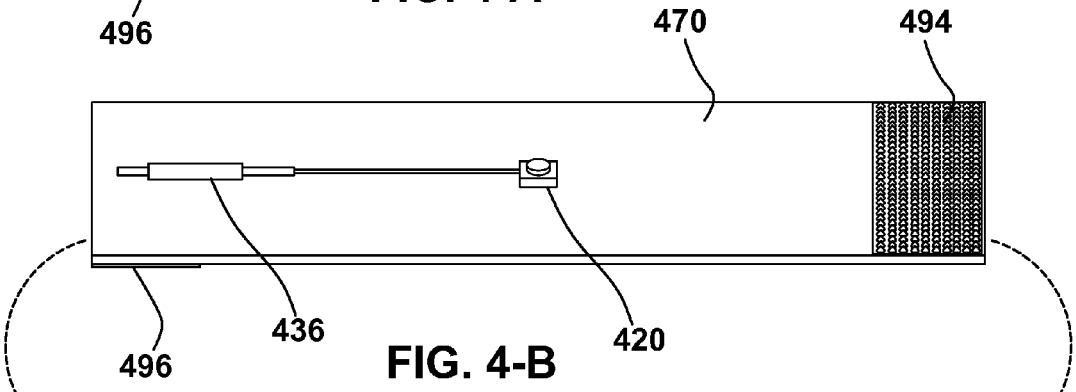
FIG. 4-B
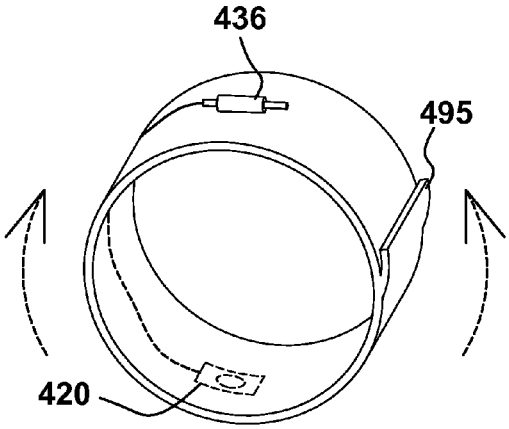
FIG. 4-C
400

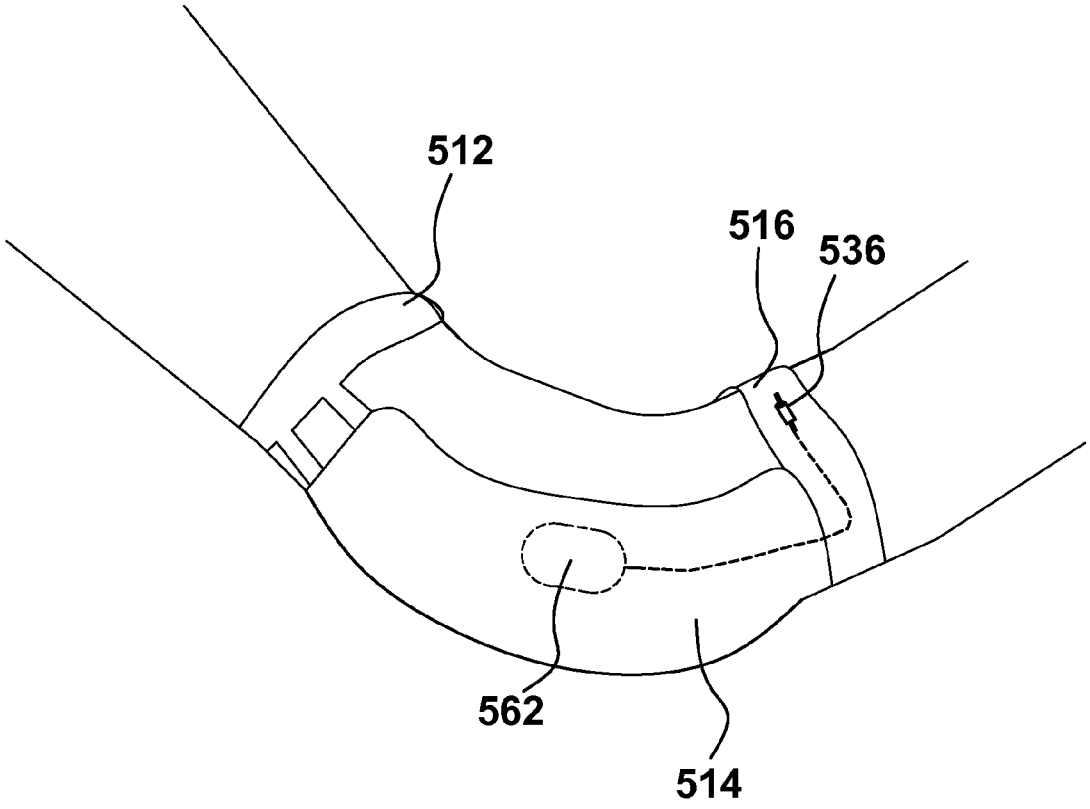
FIG. 5A
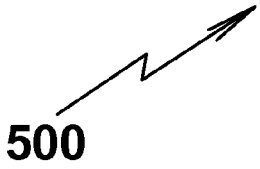

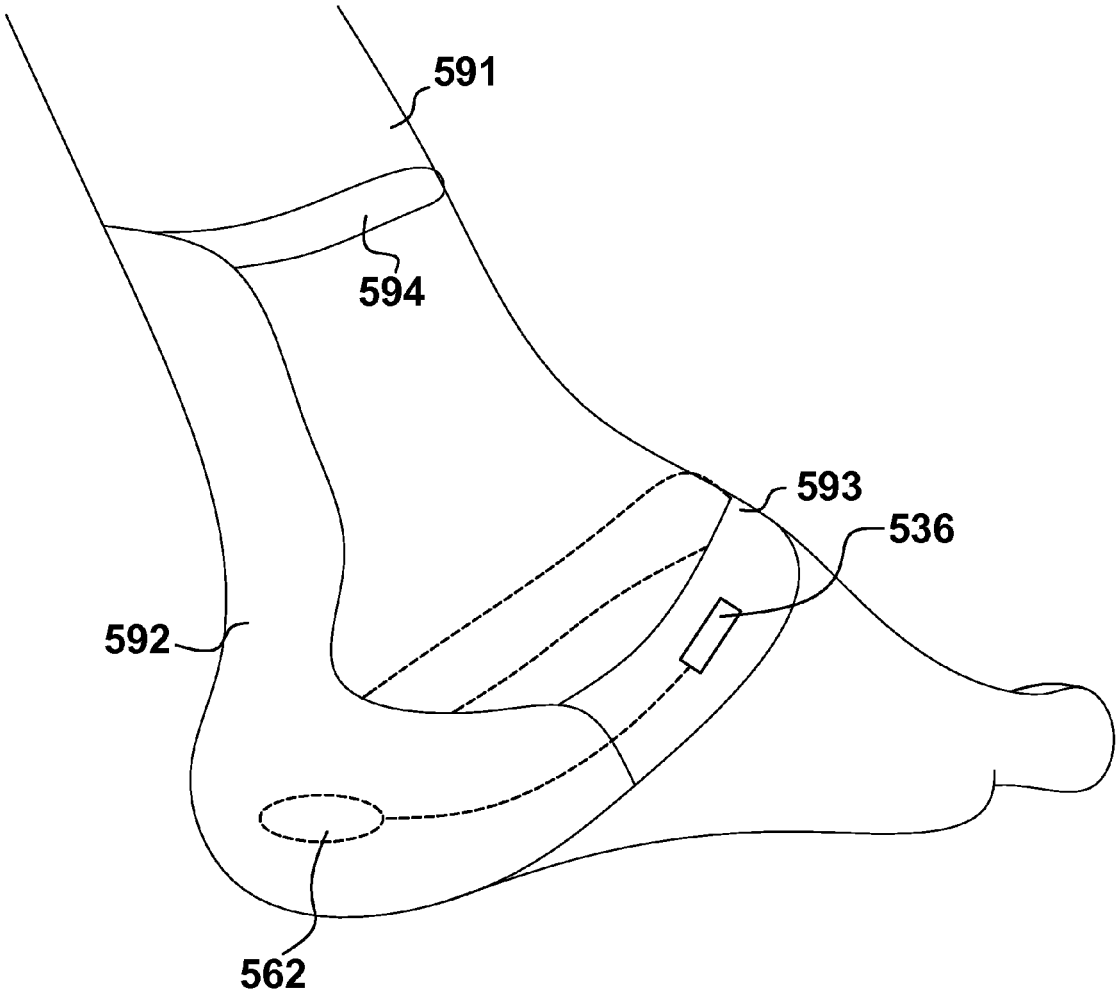
FIG. 5B
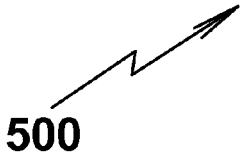

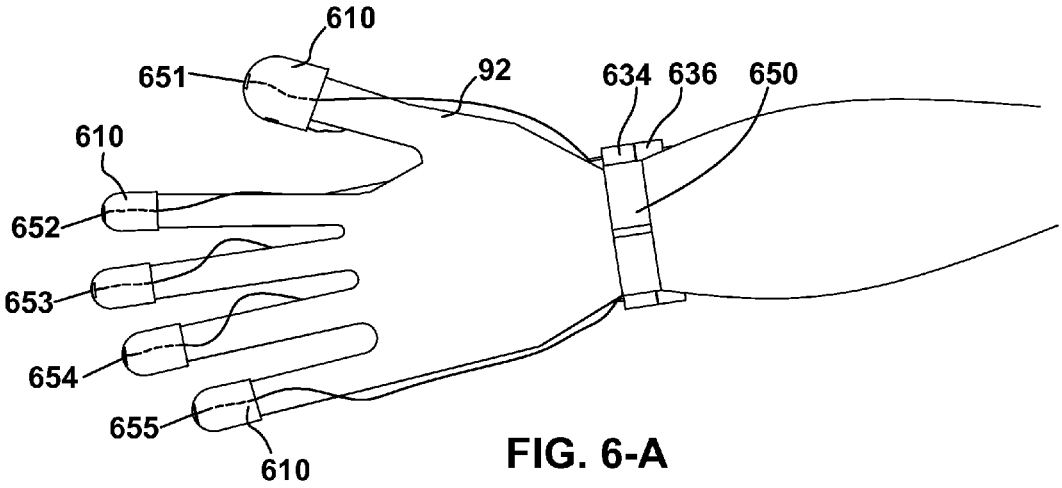
FIG. 6-A
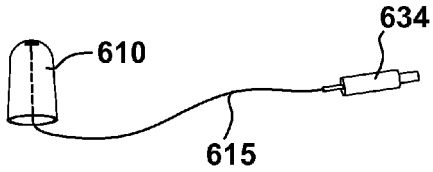
FIG. 6-B
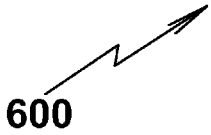

700

700

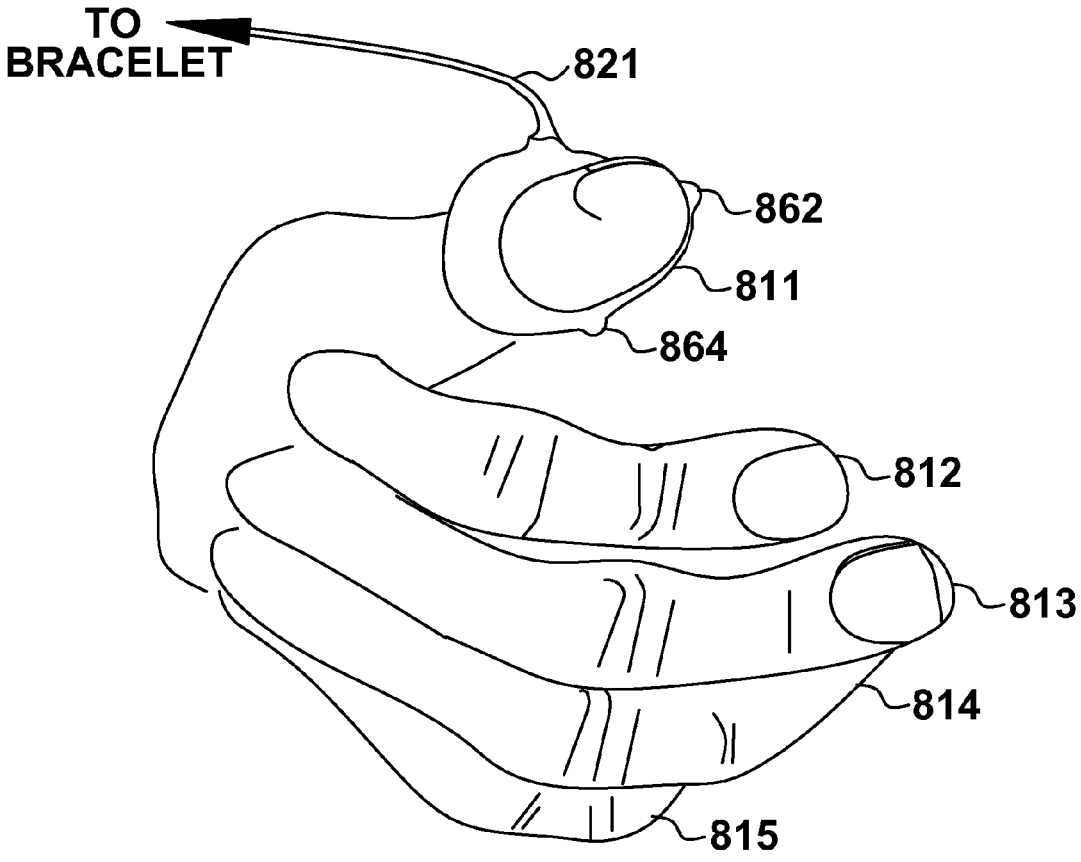
FIG. 8A
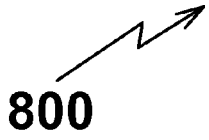

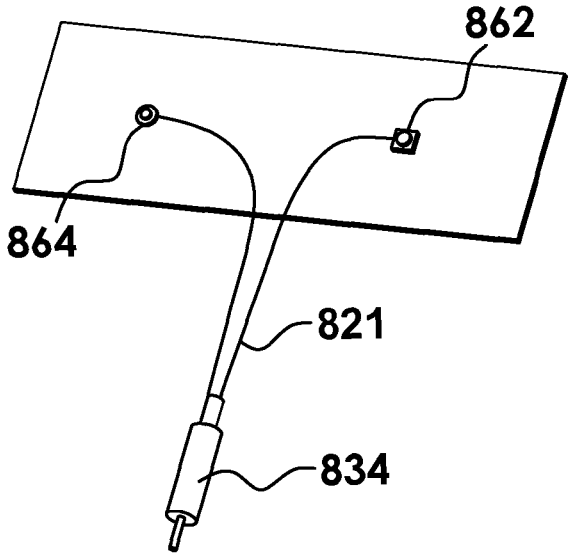
FIG. 8B
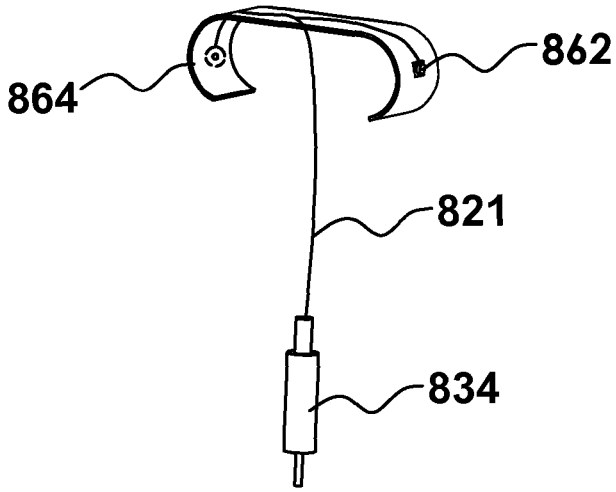
FIG. 8C
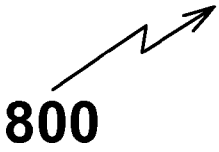

WEARABLE TRIGGER ELECTRONIC PERCUSSION MUSIC SYSTEM

CROSS REFERENCE TO RELATED CASE

This application claims priority of provisional application Ser. No. 61/267,407, filed Dec. 7, 2009, and titled, "Wearable Drum Triggers".

BACKGROUND

Prior Art

Heretofore creation, learning, and enjoyment of music has been very expensive as most musical instruments have been acoustically loud, bulky and expensive and therefore beyond the reach of ordinary people.

The following is a compilation of some possibly relevant prior art that shows various alternative musical instruments that can be made affordable by the average person.

US Published Patent Application 2009/0126554 (2009) to Xu et al. for "Finger Musical Instrument"

U.S. Pat. No. 4,414,537 (1983) to Grimes for "Digital Data Entry Glove Interface Device"

U.S. Pat. No. 4,613,139 (1986) to Robinson for "Video Control Gloves"

U.S. Pat. No. 4,635,516 (1987) to Giannini for "Tone Generating Glove and Associated Switches"

U.S. Pat. No. 4,681,012 (1987) to Stelma et al. for "Drummer's Glove"

U.S. Pat. No. 4,700,602 (1987) to Bozzio for "Electronic Drum"

U.S. Pat. No. 4,753,146 (1988) to Seiler for "Portable Electronic Drum Set"

U.S. Pat. No. 5,119,709 (1992) to Suzuki et al. for "Initial Touch Responsive Musical Tone Control Device"

U.S. Pat. No. 5,338,891 (1994) to Masubuchi et al. for "Musical Tone Control Device With Performing Glove"

U.S. Pat. No. 5,512,703 (1996) to Usa for "Electronic Musical Instrument Utilizing A Tone Generator Of A Delayed Feedback Type Controllable By Body Action"

U.S. Pat. No. 5,581,484 (1996) to Prince for "Finger Mounted Computer Input Device"

U.S. Pat. No. 6,734,349 B1 (2004) to Adams for "Fingertip Musical tap Assembly"

U.S. Pat. No. 6,819,771 (2004) to Menzies for "Vest With Piezoelectric Transducer for Practicing Music"

U.S. Pat. No. 7,012,593 B2 (2006) to Yoon et al. for "Glove-Type Data Input Device and Sensing Method Thereof"

U.S. Pat. No. 7,381,884 B1 (2008) to Atakhanian for "Sound Generating Hand Wear"

UK Patent Application 2,221,557 to Chau King Sze (1990) for "Electronic Musical Instrument"

UK Published Patent Application 2,286,035 (1995) to Pendleton for "Control Device, e.g. for Computers, with Contacts on the User's Hand"

UK Published Patent Application 2,305,714 to Rosenberg (1997) for "A Keyboard Glove"

UK Published Patent Application 2,320,315 to Heping He (1998) for "A Keyboard Glove for Use by the Blind"

WIPO PCT Published Patent Application WO 8,912,858 (1989) to Katsumi for "Manual Data Input/Output System"

There are many types of electronic gloves, most of which are intended for use in applications other than electronic music or more specifically electronic percussion.

A number of prior-art data entry patents include sensors that are located somewhere in the palm area. However, none of these employ a palm sensor as a hand percussion input or as an input that operates separately from other sensors on the glove. One patent that does employ a palm sensor to contact a surface other than another sensor on the glove is used with a surface that is wired to the palm sensor as shown in the Pendleton Application above. However that device cannot be employed to generate an electronic signal by striking any convenient planar hard or rigid surface.

Although Atakhanian does employ a sensor located generally in the palm area, that palm sensor is only used in conjunction with other finger sensors and is not used as a direct input to strike any surface for the purpose of generating a bass sound, of the type generated by the normal hand movement of a hand percussionist in striking an instrument, such as bongos, congas, tablas, etc.

The presence of a palm sensor for generating a bass input would not limit the commercial use of an e-glove or e-ring apparatus to hand percussion. The user could choose to use it for other purposes. For instance, a user could still use the glove for generating other inputs, such as striking a surface in a manner intended to generate sounds corresponding to striking a drum with drum sticks or striking cymbals.

It has been assumed that essentially the same functions could be performed with either the e-gloves or the e-rings. In some cases the e-rings can be used to generate percussion sounds for an acoustic drum set including a bass drum, snare drums tom-toms and cymbals. However, the e-glove can also be used for this purpose. In another aspect, sensors on the percussionist's feet or on other parts of the body are used.

Stereo plugs are attached to a bracelet for stereo applications. Wireless communication as an alternative to wired embodiment has been addressed, notwithstanding such wireless communication is known for other remotely or tangentially related applications.

Suzuki et al. show a glove including sensors on the fingers used for musical keyboard input. Related patents (assigned to Yamaha) are representative of prior art that employs pivotal or flexible glove sensors to detect the flexure of the wearer's fingers. This signal is used to generate an initial touch response, such as the velocity of movement of the finger, before an actual touch. The initial touch signal along with an after touch signal and a key on signal can be transmitted to an electric organ, synthesizers or similar keyboard device. These signals can be used by dancers, etc. to generate more complete musical sounds based on body movements.

Such a flex sensor, as opposed to a pressure sensor such as a piezoelectric sensor, would not appear to be suitable for use by a hand percussionist so that a signal would be generated when a surface is struck. Furthermore, such flex sensors would appear to be much more complicated. Significantly the flex sensor used on these Yamaha devices would appear to be incompatible with a palm sensor. Other examples of these Yamaha devices are shown in Usa and Masubuchi, above, among others.

Atakhanian shows a musical instrument including finger sensors and a sound box, all incorporated into a glove. The glove has separate sensors on each finger, including on the knuckle in addition to the fingertips. Palm sensors are also employed. Unique signal patterns of each of the signals from these sensors result in specific audible sounds. Speakers are mounted on the gloves and the potentiometers are used as sensors. A digital signal processor on the glove can be programmed to recognize the unique patterns. Although the sensors located near the ends of the fingers appear to be intended to create musical and rhythmic patterns by tapping their fingers on any suitable surface, the sensors located near the knuckles and in the palm regions appear intended to be contacted by the sensors near the ends to modify the audible musical sounds so that the user can create a wide range of notes, rhythms and/or melodies with the glove. The knuckle and palm sensors thus appear to be essentially "function keys" and are not intended to be used to tap or strike a surface as would the palm contact of applicant's music system. There is no suggestion that the palm sensor be used as a bass input for drums.

Xu shows a glove with fingertip keys connected to sound boxes located on the backside of a glove. The glove also includes range selection switches located on the glove heel that give a greater octave range. The fingertip sensors employed in this apparatus appear to be located on the back of the fingers at the tips and not on the interior surface that would strike a surface as part of a percussion stroke.

Giannini shows a switch that can be used at the finger joints in a glove in which a contact is made when the fingers flex about the joints. The switches appear to be located on the backside of the gloves instead of on the inside, and this glove can include an AM or FM transmitter.

Sze Chau King shows a glove musical instrument in which four finger contacts, in the form of spring members, are connected to a speaker of piezo buzzer on the back of the gloves.

Hand Wearable Sensors for Data Entry

A large number of prior art patents show glove type devices that are used for computer keyboard input or data entry. For example, Prince above discloses a glove having fingertip pressure sensors, such as piezoelectric sensors, and acceleration sensors. These sensors can be used for computer or keyboard input.

Yoon et al. above shows an input glove that includes sensors located at the fingertips. The switches can operate in a digital or analog mode. An analyzer determines input data by analyzing the sensing signal. Once the input signal in determined by the analyzer, the input signal outputs the determination signal to an external terminal. For example, digital inputs can be generated in response to a combination of simultaneously pressed sensors, the number of sensors pressed, the duration of sensor pressing or the pressure applied to sensors. Typically inputs can be generated by touching two sensors (i.e. two fingers) together. Thus the individual finger sensors do not appear to act independently.

Pendleton shows a glove having contact sensors located on the thumb and fingers of a hand, as well as a sensor located on the palm heel of the hand. The contact sensors employed in this device are intended to close a circuit when contacted with a conductive surface on a separate pad. Thus this device is not intended to generate a signal when striking any surface, such as the e-glove I e-ring apparatus. It is unclear whether the palm sensor is located in a position that would be suitable for use by a hand percussionist. I.e., a sensor may be located on the inside of the hand at a point spaced from the fingers. Clearly this device would not be used to generate a signal by striking a blow.

Grimes discloses a data entry glove having proximity touch sensors located on the fingertips. This patent also shows a knuckle bend sensor that can be located at the knuckle of the index finger and extending into the palm region. This is not a touch or percussion impact sensor. However, one embodiment of this glove employs a touch sensor at the base of the ring finger at a position that appears to be along the raised surface at the top of the palm. This touch sensor is however intended to be activated by the thumb, and would not appear to comprise a sensor for detecting strikes by the hand.

Prince shows finger mounted device for computer input. The sensors mounted on the tips of the fingers appear to be accelerometers.

Rosenberg discloses a keyboard glove in which finger sensors are located on the palm side of the fingertip of the glove is approximately the same position as the finger sensors in e-glove. This keyboard entry device is intended to function as a chord keyboard, a special data entry keyboard that uses fewer keys than a QWERTY keyboard. It has shift or function sensor keys located along the side of the index finger, but does not include any keys or sensors in the palm as in the e-glove or e-ring device.

A specialized data entry device is shown in Heping He, which shows a glove with sensors that generate signals in response to the hand position code used by blind people. Between 45 and 47 push buttons on each glove are located on each finger and in the palm area, so that when touched by fingertips, which extend beyond the glove, according to the standard hand position code, an appropriate signal is transmitted to a computer. This is explicitly a soft touch device. The only relevant teaching is that sensors can be located on the palm. However multiple soft touch palm sensors are employed and it would not seem plausible that a glove of this type could be used by hand percussionist, nor would this device suggest the e-loops, e-ring or e-glove embodiments.

Gloves for Use as Computer Game Input Devices

Robinson discloses a glove with electrical contacts located on the fingers and the thumb for generating inputs to a joystick control port. Signals appear to be generated by touching the thumb to one of the fingers.

Gloves for Generating MIDI Inputs

A number of Internet postings discuss gloves suitable for MIDI inputs. An example of an item termed a Wireless MIDI glove using flex sensors and a series of wires leading to what appears to be a wireless transmitter is shown at http://vipre.uws.edu.aultieml?p=605. I have found many types of electronic gloves, most of which are intended for use in applications other than electronic music or more specifically electronic percussion.

None of these prior-art devices employ a palm sensor as a hand percussion input or as an input that operates separately from other sensors on the glove. The one patent that does employ a palm sensor to contact a surface other than another sensor on the glove is used with a surface that is wired to the palm sensor as shown in the Pendleton application above. That device cannot be employed to generate an electronic signal by striking any convenient surface.

The presence of a palm sensor for generating a bass input would not limit the commercial use of an e-glove or e-ring apparatus to hand percussion. The user could choose to use it for other purposes. For example, a user could still use the glove for generating other inputs, such as striking a surface in a manner intended to generate sounds corresponding to striking a drum with drum sticks or striking cymbals.

SUMMARY

Various aspects of my apparatus and associated methods are an improvement over prior art drum kits. My apparatus allows one to play drums without the cost and logistics of drums or a drum-kit. A donnable garment with pressure and trigger sensors creates music, in response to essentially the same hand movements that would be used in striking bongas, congas, tablas, or similar hand-struck musical instruments. These include the same foot movements in controlling the open-close hi-hat or a bass drum, as if on a real drum kit, so as to make the system user or musician transparent.

DRAWINGS

The following is a brief description of the several views of the drawings complete with reference numerals. The last two least significant digits represent the item (not necessarily tangible) number and the left most one or two digits represent the figure number.

FIG. 1 is a pictogram of a musician sitting on a stool, creating and enjoying the music with the modules and accessories of the Wearable Trigger Electronic Percussion Music system of this apparatus interconnected and interfaced including a variety of wearable and/or donnable garments with embedded sensors, music module, electronics module pre-amplifiers and amplifiers, wired headphones, loudspeakers with wireless interface option.

FIG. 2-A is a block diagram of the system showing a piezo pressure sensor/transducer, pre-amp and music module, electronic connection device, and amplifier, as well as wired head phones and loudspeakers. FIG. 2-B shows a wireless embodiment of block diagram of FIG. 2-A shown complete with a piezo pressure sensor/transducer, pre-amp and music module, electronic connection device, and amplifier, as well as wireless transmitters and wireless receivers, head phones with wireless interface and loud speakers also with wireless interface.

FIG. 3-A shows the palm side of a hand with a plurality of sensors on fingers, palm of the hand, a force sensor resistor (FSR) at the base of the palm, and a bracelet for facilitating connections from sensors to pre-amp, electronics and music module. FIG. 3-B shows a left foot with a wireless transmitter and concomitant interface. The right foot generally includes one or more sensors for tapping, etc.

FIG. 4 is shows show a sensor on a strap or band which is used with an eye-and-hook fastener to form a loop or band around a finger, palm, or foot. FIG. 4 shows this operation in three steps as follows: FIG. 4-A shows the sensor being placed on a loopable strap on top of one end of a hook fibrous fastener and on the underside of the other end with a mating eye fastener(s). FIG. 4-B shows the sensor and a connector with male end connected to the sensor and the female end female for mounting on the bracelet on the wrist of the musician of FIG. 1, for example. FIG. 4-C shows the looped strap with a sensor and a connector ready for mounting the palm to receive and house the sensor and the wrist to receive the bracelet on which is mounted the connector for further connecting to a pre-amp or music module or electronics module as needed.

FIG. 5-A shows the arm of a musician with the sensor mounted on the elbow; it is easily activated by hitting the elbow on any hard planar surface. The sensor can also be a pressure sensor or FSR instead of the tactile switch such that it is not necessary to hit the elbow against a planar surface; the sensor can be activated by pushing against a planar surface instead of impact hit. It is a sensor primarily for pressing and secondarily for hitting. This is analogous to the original natural movement that most percussionists are used to bend or stretch the skin of the playing surface to modulate the acoustic pitch and/or sound. FIG. 5-B depicts the mounting of a sensor on the heel of the right foot so that the left foot is free to house a wireless transmitter interface if one is desired.

FIG. 6-A delineates the location of sensor on a finger with a finger cap instead of the loop of FIG. 4. It shows hand the finger caps and sensors at the tips and a wired connection to a connector mounted on a bracelet on the wrist of the musician. Delineated are thumb 651, index finger 652, middle finger 653, ring finger 654, and little finger 655. FIG. 6-B shows in greater detail the finger cap, sensor, connector, and a wired connection between the sensor and the music module. The male and female connectors may be interchanged without nay degradation in performance with the aid of convertors which can convert one kind of connector male or female to the other type.

Figure 7A:
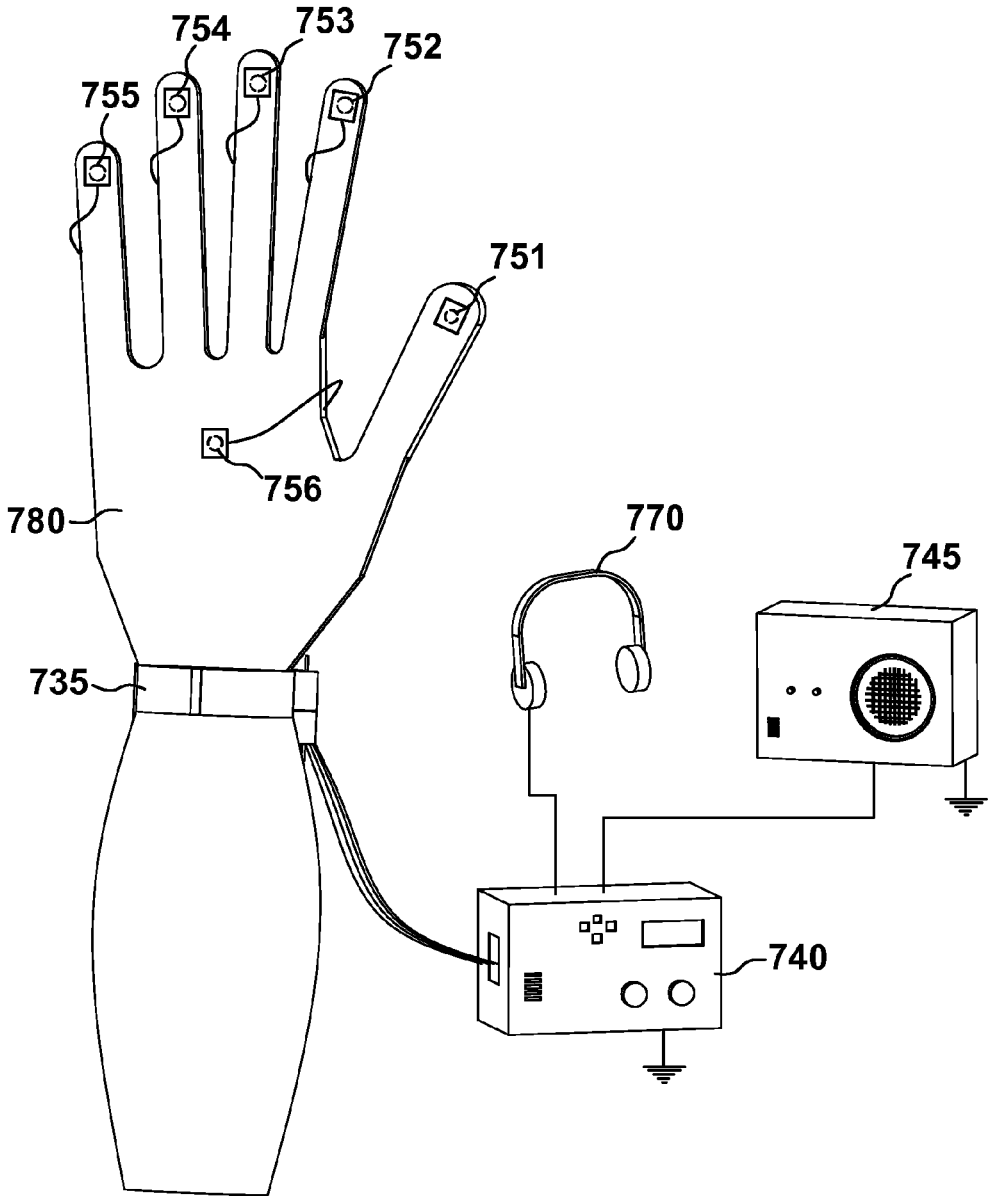
Figure 7B:
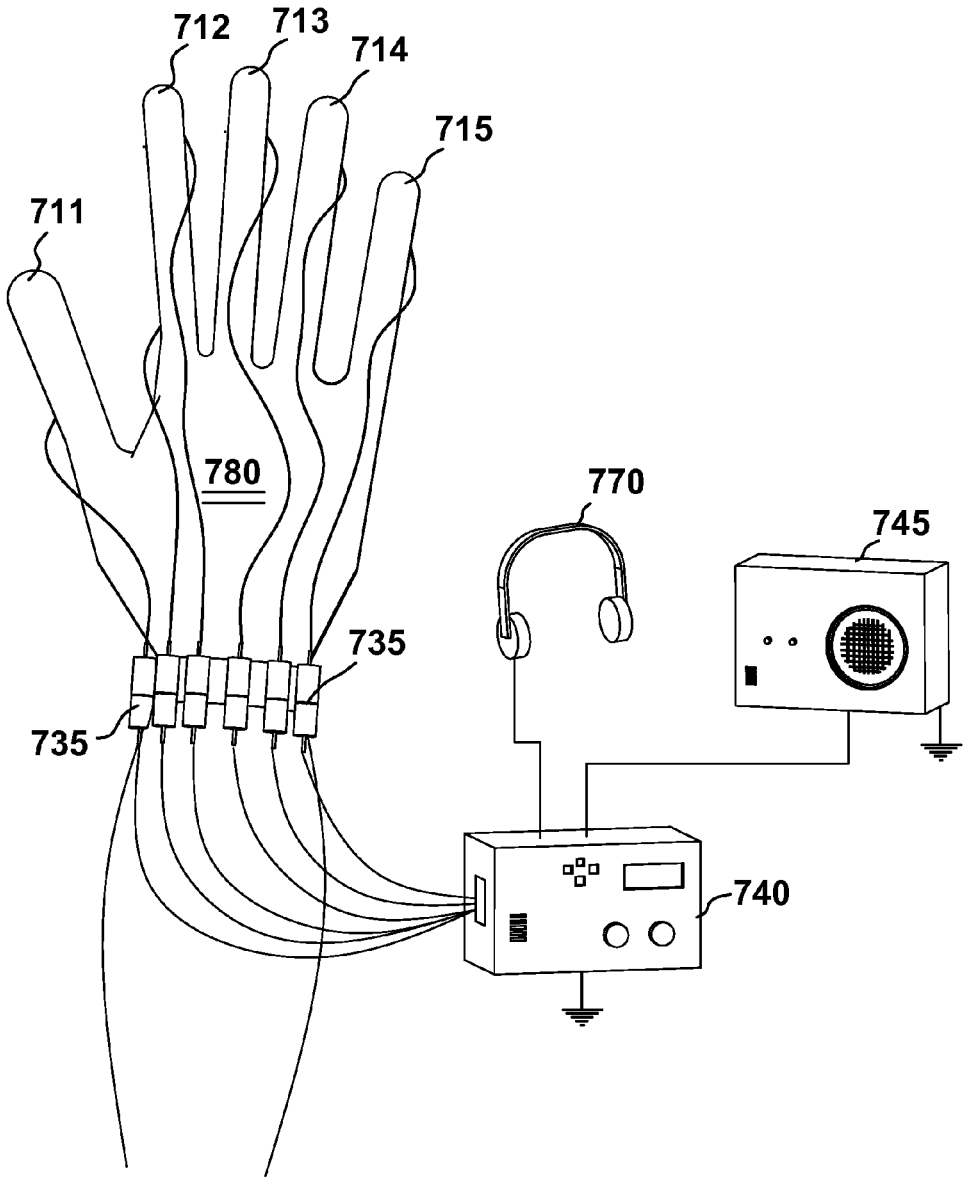

FIG. 7-A shows the glove embodiment with plurality of sensor(s), one for each finger, a sensor on the palm, and a bracelet on the wrist for facilitating connection to a music module, which is shown further with an interface to an amplifier, a speaker, headphones, etc. Additionally an FSR (not shown) may be employed on the base of the palm similar to sensor 360 of FIG. 3-A. FIG. 7-B shows the back side of the glove of FIG. 7-A FIGS. 8-A to 8-C show a protocol for playing a cymbal and snubbing (arresting, stopping halting, interrupting, choking, muting, or the like) as a musician would do in a concert. However here it is done with only one hand and without any orchestra. FIG. 8-A shows a perspective view of a hand in partially fisted (and hence partially open) position. This FIG also shows two sensors, a pressure sensor positioned on the outside of the thumb for initiating the cymbal sounds and a tactile switch positioned on the underside of the thumb, such that if a first is made then the contact of the thumb sensor with the index finger triggers this sensor to arrest the sound of the cymbal suddenly, abruptly and sharply. FIG. 8-B shows the two sensors on a loopable band with a piezo pressure sensor on the left side of the band or strap and the tactile sensor switch on the right side of the same band and the two wires are connected to a connector. For ease the connection is male on both ends for the righthand cymbal operation. FIG. 8-C shows the strap of FIG. 2-B curved as it will be looped around the thumb such that the piezo pressure sensor is on the outside of the right hand thumb and the tactile trigger is on the underside of the thumb; this can also be used for the righthand cymbal operation. FIGS. 8-B and 8-C show a left hand cymbal operation where the sensor positions on the band are reversed because left and right hands are mirror images of each other.

REFERENCE NUMBERS

001=Thumb
002=Index Finger
003=Middle Finger
004=Ring Finger
005=Little Finger
010=Hand
012=Palm
015=Elbow
020=Foot
022=Toes
025=Heel/Ankle
080=Glove
085=Mitten
090=Musician
091=Leg
09S=Stool/Chair
099=Logic &/or Power Ground
100=Embodiment of FIG. 1 generally
110=Hand Sensor and Loop
115=Elbow sensor support member
120=Foot Sensor and Loop
125=Heel/Ankle Sensor support
130=Finger Sensor support with loop, strand, band, ring, cap etc.

135=Interconnection Module generally mounted on a bracelet worn on the wrist.
140=Electronics and Music module.
145=Amplifier
160=Sensor generally
161=Accelerometer
162=Piezo pressure sensor
163=Thin film pressure sensor
164=Tactile sensor
165=Gyroscope as a sensor
166=Force Sensor Resistor (FSR)
168=Micro-Arduino
190=Foot loop for wireless interface
192=Wireless IIF on foot loop
200=Embodiment of FIG. 2 generally
220=Pressure transducer
235=Interconnection module conFIGd on a bracelet
240=Music module
245=Amplifier
255=Wireless Transmission Interface
265=Wireless Receiver Interface
272=Headphones with wireless receiver interface
275=Loud Speakers with wireless receiver interface
300=Embodiments of FIG. 3 generally
320=Foot Loop for wireless interface
322=Wireless Interface on Foot Loop
334=Male connector
335=Inter Connection Bracelet or Module
336=Female connector
340=Music module
345=Amplifier
350=FSR and support in the palm
351=Thumb sensor and support
352=Index Finger sensor and support
353=Middle Finger sensor and support
354=Ring Finger sensor and support
355=Little Finger sensor and support
356=Sensor in palm or arch of foot
396=Left Foot of musician
400=Embodiment of FIG. 4 generally
420=Piezo pressure sensor and support
434=Male connector
435=Inter Connection Bracelet or Module
436=Female connector
470=Band Loop or strap used as sensor support
494=Hook fastener
495=Fastener generally eye and hook matching type
496=Eye fastener
500=Embodiment of FIG. 5 generally
510=Upper Securing Member
514=Elbow sensor support
516=Lower securing member
536=Female connector
562=Heel or ankle Sensor and support
591=Leg
592=Heel/Ankle sensor support
593=Lower securing member
594=Upper securing member
600=Embodiment of FIG. 6 generally
610=Finger caps or loops
622=Index Finger sensor and support
626=Sensor in Palm with loop support
634=Connector (Male) on connecting module
635=Interconnection module typically an ornamental bracelet
636=Female connector on connecting module sometimes in the form of bracelet
651=Thumb sensor
652=Index finger sensor
653=Middle finger sensor
654=Ring Finger sensor
655=Little finger sensor
700=Embodiment of FIG. 7 generally
711=Thumb sensor
712=Index finger sensor
713=Middle finger sensor
714=Ring Finger sensor
715=Little finger sensor
734=Male connector
735=Inter Connection Bracelet or Module
736=Female connector
739=Music module sensor connector via Bracelet connection module
740=Music module
745=Amplifier
751=Thumb sensor and support
752=Index Finger sensor and support
753=Middle Finger sensor and support
754=Ring Finger sensor and support
755=Little Finger sensor and support
756=Sensor in palm
770=Headphones
786=Glove
800=Embodiment of FIG. 8 generally
811=Thumb sensor and support
812=Index Finger sensor and support
813=Middle Finger sensor and support
814=Ring Finger sensor and support
815=Little Finger sensor and support
821=Stereo sensor cable
834=Male connector
862=Pressure sensor mounted on outside of thumb for initiating cymbal choke effect
864=Tactile sensor on underside of thumb for halting cymbal choke effect

DEFINITIONS AND ACRONYMS

I have used words with their conventional dictionary definitions. The following definitions are included here for clarification.

3D=Three Dimensional
Bongo(s)=One of a pair of small tuned drums played by beating with fingers.
Conga(s)=A tall conical Afro-Cuban drum played with hands.
Cymbal=A concave plate generally of brass or bronze that produces a sharp ringing sound when struck, which may be played either in pairs by being struck together or singly by being struck by a drumstick or the like object.
DIY=Do It Yourself
Finger Caps)=Thimble of sewing trade that is adapted as musical trigger with incorporation of a trigger sensor.
FSR=Force Sensor Resistor
Hi-Hat=A pair of cymbals (typically dish-shaped plates of brass) mounted on a rod so that an upper cymbal can be lifted and dropped or released on a lower cymbal by a foot pedal.
IC=Integrated Circuit
I/O=Input and Output
Integrated=Combination of two entities to act like one
Interface=Junction between two dissimilar entities
LED=Light Emitting Diode
PCB=Printed Circuit Board Piezo=One type of pressure sensor or transducer Pixel=Smallest/finest resolution on a display.

Planar=Any rigid playing surface which in conjunction with wearable sensors produces the music of a variety of percussion instruments of various types from various countries and cultures including but not limited to congas, tablas, cymbals, table top, counter top, desk, table or the like surface of almost any rigid plastic or metal Sensor(s)=any transducer to which when pressure is applied produces sound of a musical instrument (in cooperation with a music module) such as bass, snare, tom toms, cymbals, hi-hat controls, tabla, conga or any other percussion, string or wind musical instrument. Examples of such sensors and transducers include but are not limited to piezo pressure sensor, tactile impact switches, FSRs, even gyroscope(s) and accelerometer(s) or the like.

Symmetrical=The shape of an object of integrated entity which can be divided into two along some axis through the object or the integrated entity such that the two halves form mirror image of each other.

Tabla=An Indian musical percussion instrument played with hands and fingers tapping on a small drum tuned to different pitches

DETAILED DESCRIPTION

First Embodiment

The Wearable Trigger Electronic Percussion Music System is shown in the several views of the drawings. The embodiments shown are not limited in its application to the details of construction and to the arrangements of the components forth in the following description or illustrated in the drawings. Other embodiments and aspects can be practiced and carried out in various ways. Also the phraseology and terminology employed are for the purpose of descriptions and should not be regarded as limiting their scope.

FIG. 1 is a pictogram of a musician sitting on a stool, creating and enjoying the music with the modules and accessories of the system as it is interconnected and interfaced including a variety of wearable and/or donnable garments with embedded sensors, music module, electronics module pre-amplifiers and amplifiers, wired headphones, and loudspeakers with a wireless interface option. It is shown complete with glove 80 on the left hand and palm sensor 110 and loop sensors 130 on the fingers of the right hand of a musician 90 seated on a stool/chair 95. also shown are modules with logic and power ground 99, hand/palm sensor and loop 110, foot sensor and loop 120, finger sensor support with loop, strand, band, ring, cap 130, interconnection module generally mounted on a bracelet worn on the wrist 135, electronics and music module 140, amplifier 145, and plurality of sensors 160.

FIG. 2-A is a block diagram of the system showing a piezo pressure sensor/transducer, pre-amp and music module, electronic connection device, amplifier, as well as wired head phones and loudspeakers. The block diagram is shown complete with a piezo pressure transducer 220, interconnection module configured on a bracelet 235, music module 240, amplifier 245, wireless transmission interface 255, wireless receiver interface 265, headphones with wireless receiver interface 272, loudspeakers with wireless receiver interface 275.

Alternative Embodiment

Wireless Option

FIG. 2-B shows a wireless version of the embodiment of FIG. 2-A, complete with a piezo pressure sensor/transducer, pre-amp and music module, electronic connection device, and amplifier, as well as wireless transmitters and wireless receivers, headphones with a wireless interface and loudspeakers, also with a wireless interface. The wireless connection is an alternative to the cable connection. It shows the connective sequence using the wireless connection between the elements. Any type of wireless connection can be used.

To provide even greater degree of mobility a wireless radio connection to a mobile phone or smart phone, such as that sold under the trademark BlueTooth, may be employed. A piezo transducer or some other sound pressure transducer-to-electronic voltage signal is connected to the proper electronic connective device, such as the bracelet (shown in FIGS. 1, 3 6 & 7) with a wireless transmitter (that runs on batteries). The latter transmits the signal or the information to the wireless receiver, which may be a part of a drum module, some other sound module, or other appropriate musical equipment.

After receiving the signal or the information the receiver further sends the sound, sound signal, or the information from the wireless transmitter (instead of a cable) to be picked up by the receiver of headphones or an amplifier intended to be used.

The state of the art wireless interfaces are miniature enough that they can be easily used for transmission of sensor signal wirelessly to the nearest module in close range of a few feet or the range may be extended with amplification. The wireless option works the same way for a heel carrier, elbow carrier, finger caps, palm strap carrier, foot carrier, and glove embodiments. Hybrid wired and wireless environments may also be employed.

FIGS. 3-A and 3-B show a hand and foot embodiment. FIG. 3-A shows the palm side of a hand with a plurality of sensors on the fingers, palm of the hand, a FSR at the base of the palm, and a bracelet for facilitating connections from sensors to a pre-amp, or an electronics and music module. FIG. 3-B shows a left foot with wireless transmitter and concomitant interface. The right foot generally includes one or more sensors for tapping, etc. FIG. 3 is shown complete with a foot loop wireless interface 320, a wireless interface on foot loop 322, a male connector 334, an interconnection bracelet or module 335, a female connector 336, a music module 340, an amplifier 345, a FSR and support 350 in the palm of hand 330, a thumb sensor and support 351, an index finger sensor and support 352, a middle finger sensor and support, 353, a ring finger sensor and support 354, a little finger sensor and support 355, and a sensor in palm (or arch of foot) 356. A glove (not shown) may also be used. The left foot 396 of the musician may hold a wireless interface 392.

FIG. 4A shows a sensor on a strap or band which is used with an eye-and-hook fastener to form a loop or band around a finger, palm, or foot. It is shown complete with piezo pressure sensor 420, interconnector 436, band loop or strap 470, used as sensor support, hook fastener 494, a fastener (generally eye-and-hook matching type) 495, and Eye fastener 496. FIGS. 4-A, 4-B, and 4-C of FIG. 4 show this operation in three steps as follows.

FIG. 4-A shows the sensor being placed on a loopable strap on top of one end of a hook fibrous fastener and on the underside of the other end with a matching eye fastener(s).

FIG. 4-B shows the sensor and a connector with male end connected to the sensor and the female end female for mounting on the bracelet on the wrist of the musician of FIG. 1, for example.

FIG. 4-C shows the looped strap with sensor and connector ready for mounting to receive and house the sensor and the wrist to receive the bracelet on any suitable limb and any suitable mounting for further connection to a pre-amp or music module or electronics module as needed and deemed appropriate. The loop is suitable for any type or size of limb.

FIG. 5-A shows the arm of a musician with the sensor mounted on the elbow which is easily activated by hitting the elbow on any hard planar surface. the sensor is shown here complete with an upper securing member 510, an elbow sensor support 514, and a lower securing member 516. The sensor can also be a pressure sensor or FSR instead of the tactile switch. As such that it is not necessary to hit the elbow against a planar surface as the sensor can be activated by pushing against a planar surface. It is a sensor primarily for pressing and secondarily for hitting. This is analogous to the original natural movement that most percussionists are used to bend or stretch the skin of the playing surface to modulate the acoustic pitch and/or sound.

FIG. 5-B depicts the mounting of a sensor on the heel of the right foot, shown here complete with a Heel or ankle Sensor and support 562, Upper securing member is mounted on leg 591 and Lower Securing member on foot 592. This embodiment typically includes a piezo pressure transducer on the arch of the right foot for simulating a bass drum sound. Typically either all of the embodiments are wired or wireless. In the wireless option each sensor also includes its own self-contained transmitter just like self contained battery.

FIGS. 6-A and 6-B delineate the location of sensor on a finger with a finger cap instead of the loop of FIG. 4, shown here complete with hand finger caps 610 and sensors at the tips of thumb 651, index finger 652, middle finger 653, ring finger 654, and little finger 6S5. A connector (male) 634, an interconnection bracelet or module 635, and a female connector are shown. The latter is shown as follows: FIG. 6-A shows the hand with the sensor and finger cap on the index finger and a wired connection to a connector mounted on the bracelet on the wrist of the musician. FIG. 6-B shows in greater detail the finger cap, sensor, connector and a wired connection between the sensor and the music module. The male and female connectors may be interchanged without any degradation in performance with the aid of convertors which can convert one kind of connector (male or female) to the opposite gender.

FIG. 7 shows the glove embodiment complete with a male connector 734, an inter connection bracelet or module 735, a female connector 736, a music module sensor connector via bracelet connection module 739, a music module 740, an amplifier 745, a thumb sensor and support 751, an index finger sensor and support 752, a middle finger sensor and support 753, a ring finger sensor and support 754, a little finger sensor and support 755, a sensor in palm 756, headphones 770, and a glove 780 which acts as support for individual sensors on the fingers.

More particularly FIG. 7-A shows the glove embodiment with plurality of sensor(s), one for each finger, a sensor on the palm and a FSR on the base of the palm and a bracelet on the wrist for facilitating connection for a music module, which is shown further with an interface to an amplifier, a speaker, headphones, etc. Likewise FIG. 7-B shows the back side of the gloved hand of FIG. 7-A.

Cymbal Choke Effect

FIGS. 8A to 8-C show a protocol for playing a cymbal and snubbing (arresting, stopping halting, interrupting, choking, muting, or the like) as a musician would do in a concert. However here it is done with only one hand and without any orchestra. A piezo transducer is mounted on the left side of the band while the tactile switch is mounted on the right side of the band. The stereo cable with stereo jack connected to them so when the piezo is hit it gives the cymbal sound as stored in sound module.

When the piezo transducer is struck or otherwise impacted the pressure is converted into an electrical voltage and is sent to the electronic pre-amp and sound module. The player controls impact mode, orientation and timing, etc. by squeezing, between palm and index finger, the tactile switch. This immediately stops the signal, which in turn and stops the sound of the cymbal from the sound module.

The cable and jack cannot be mono. If it's mono then only one of these sensors could be in use. Otherwise only the cymbal initiation or only the tactile switch for stopping the cymbal music can be used. That is why it has to be stereo. Stereo cable uses two wires in one sleeve and is divided like a Y.

This alternative embodiment more particularly illustrates the protocol for the cymbal choke effect. FIGS. 8-A, 8-B, and 8-C show thumb sensor and support 811, index finger sensor and support 812, middle finger sensor and support 813, ring finger sensor and support 814, little finger sensor and support 815, stereo sensor cable 821, male connector 834, interconnection bracelet 835, Female connector 836, Pressure sensor 862 mounted on outside of thumb for initiating cymbal sound (s), and Tactile sensor 864 on underside of thumb for halting cymbal sound(s).

FIG. 8-A shows a perspective view of a hand in a partially closed position. This FIG also shows two sensors, a pressure sensor positioned on the outside of the thumb for initiating the cymbal sounds and a tactile switch positioned on the underside of the thumb. If a first is made then the contact of the thumb sensor with the index finger triggers this sensor to arrest the sound of the cymbal suddenly, abruptly, and sharply.

FIG. 8-B shows the two sensors on a loopable band with a piezo pressure sensor on the left side of the band or strap and the tactile sensor switch on the right side of the same band. Two wires are connected to a connector which, for ease of connection, is male on both ends. Similarly FIG. 8-C shows the same strap of FIG. 2-B, curved as it will be looped around the thumb such that the piezo pressure sensor ends up on the outside of the right hand thumb and the tactile trigger on the underside of the thumb.

The present system is also adoptable for dancers. The whole foot may be covered with sound transducers and sensors like a sock (not shown) which would be used by the dancers. The sensor caps are for the front part of the foot, like the front half of the sock that is carrying sound transducers of all kinds, like a piezo sensor, FSR, and even gyroscopes and accelerometers. All of these provide added flexibility to custom design the system for specific objectives, such as user friendliness, cost effectiveness, durability, portability, and all types of other design criteria. The front part of the foot pressure switch can be effectively amplified with one or more sensors of different kinds. The extent of mix and match permutations and combinations is limited only by the imagination of the design engineer.

USE & OPERATION

The operation and use of system is simple and even intuitive. The device provides all the benefits of a as a drum kit but without the expense and bother. The process is also equally simple. a 'do-it-yourself' process of creating live music in real time without the use of musical instruments comprises following steps.

1. Mount at least one sensor on at least one limb of a musician by at least one type of mounting to create music of at least one musical instrument.

2. Interface the sensor(s) with an electronics and music module.

3. Select at least one musical instrument is from a group consisting of percussion, key, wind, and string.

4. Further select the percussion instrument from a group consisting of bass drum, snare drum, tom toms, cymbals, hi-hat control, conga, and tabla.

S. Store the sounds of the selected musical instrument(s) in the music module.

6. Interface the output of the electronics and music module to an audio output device.

7. Create music by actuating one or more sensor(s) on one or more limb(s) of a music student or enthusiast against any hard planar surface.

8. Select at least one sensor from a group consisting of tactile, piezo-pressure, pressure-sensitive film, FSR, accelerometer, micro-Arduino, and micro-gyro. (Arduino is a trademark of Arduino, LLC, Cambridge Mass., for a microcontroller.)

9. Select a mounting method from a group consisting of loops, straps, bands, caps, films, gloves, mittens, elbows, ankles, and heels.

10. Mount the selected sensor(s) on a limb. In this patent "limb" means any body part on which a sensor can be mounted, similar to mounting on a limb, namely a body part selected from a group consisting of a finger, a palm, a thumb, a toe, a foot, an elbow, an ankle, a heel, a head, and a back. In this do-it-yourself process of creating live music in real time, a percussion instrument is selected from a group consisting of bass drum, snare drum, tom toms, cymbals, hi-hat control, conga and tabla. Furthermore the cymbal choke effect can be simulated by use of a pressure sensor mounted on the outside and a tactile sensor mounted on the underside of the thumb. The cymbal choke effect is initiated by actuating the pressure sensor by momentary impact of the outside of the thumb against any planar hard surface. The sound is choked and snubbed by making a fist such that the tactile sensor is actuated as it is pushed against the index finger of the fist.

The user wears on (straps on) any other of the wearable musical garments: gloves, finger straps (rings), finger caps, foot straps, or a heel and elbow strap. The user connects it (with cable or wireless) to the drum module, sound module midi sequencer, or any midi apparatus which can transform the signal into information which can be used with virtual studio technology. When connected properly one can listen to the sound via headphones or by an amplifier and speakers).

The user touches or hits any hard surface with a part of the body where the wearable drum trigger is placed. The signal is picked up by a sound transducer placed inside the wearable material, which sends the signal to the appropriate sound module via a cable or wirelessly, where it becomes the sound of an instrument or its part that the user wanted to hear.

The user can play the complete drum set if they puts the wearable drum triggers on their hands and feet. The elbow strap properly imitates a conga dampening skin effect and other percussive and non-percussive instruments and techniques. Any of the sound transducers, for example a foot strap with a tactile switch, can be used as a switch to change programs or sound banks in the drum and sound module.

One can use wearable drum triggers to play piano sounds through midi interface equipment and VST instruments. They can the tactile switches in their foot and heel straps as a octave changer for the finger straps or they can use the caps or as a modulation tool. Since we can use only five tones with five fingers, any of the wearable triggers may have a different role, depending on the user's musical equipment and musical wishes. For example the fingers of the hand can serve as different drum elements which are usually played with hands or drumsticks (snare drum, tom toms, cymbals etc.) while the foot straps can serve as a bass drum and hi-hat pedal, which is the traditional drum setup.

Hi-Hat Control

The hi-hat open-closed sound control is performed between the sensor carrier on the arch of the left foot (FIG. 3-B) with a tactile switch or FSR and a piezo pressure sensor on one of the fingers, typically the right hand. This cable with a male jack is plugged into the music module instead of a drum module's receptacle. Likewise the hand finger sensor is plugged into the jack specified for a hand hi-hat sound. The module then controls and interconnects the signals while playing. Thus the player plays the hi-hat sound with the hand sensor and controls the open/closed sound of hi-hat cymbals by raising the arch of the left foot.

One can easily use the system while practicing, composing, working on creations at home by computer or on the road with a portable standalone module or other adequate equipment, like a portable computer, mobile phone computer, or any appropriate piece of equipment with a midi interface option. The wearable drum triggers can be used with any part of the equipment (standalone or midi interface).

Analogous to stretching a drum skin, applying a pressure can also be done with base of a palm instead of an elbow. It can be done with the FSR or a pressure sensor placed at the base of the palm. A connector from the palm piezo sensor to a bracelet is shown in FIG. 3-A.

CONCLUSIONS, RAMIFICATIONS, AND SCOPE

While the present apparatus has been described with reference to illustrative embodiments, this description is not intended to be construed in a limiting sense. Various modifications and combinations of the illustrative embodiments as well as other aspects of the embodiments will be apparent to a person of ordinary skill in the art upon reference to this description.

Many other alternate embodiments and variations are anticipated. For example both the pressure sensor at the base of the palm and the cymbal "choke" option trigger switch may also be incorporated into the gloves embodiment also or a different limb may be used than those used and illustrated here in various embodiments to create the same music. With a little bit of creativity and ingenuity almost any limb can be used for any music or dance especially latest fad or craze dances.

Variations in size, materials, shape, form, function and mode of operation and assembly as well as use are possible without deviating from the embodiments shown. Examples of such contemplated variations include the following:

1. The value and the tolerance of various electronic components may be modified.

2. The wearable triggers may be built with newer materials, technologies and processes as they become available.

4. Any number and any type of sensors may be mounted on in any orientation in or on any donnable flexible material of any type to fit a body limb, including the hand, fingers, foot, toes, arm, leg, ankle, elbow, and even the head, torso, and seat.

5. Any electronic printed circuit board and its conductors can be made of different materials as they become available due to the technological progress in polymer chemistry.

6. Additional complimentary and complementary functions and features may be added.

7. A more economical or an upscale version of the device may be adapted.

8. A music module to simulate any kind of music may be incorporated for each type of musical instrument, including percussion, string, wind, etc.

9. Some of the hardware components, such as pre-amps and amplifiers, etc, may be realized by equivalent firmware or software.

10. Instead of parallel signals with plurality of lines, a single a serial line may be used to bus signals from sensors to the music module, the amplifier, the speakers, etc.

11. An analog-to-digital conversion may be employed when deemed cost effective for an application.

12. Donnable garments in the form of gloves or rings can also be used for additional purposes. For example, drumstick strikes on a drum or a cymbal could be imitated, and the hand worn device can also be used to provide inputs characteristic of keyboard instruments or even for data entry or game playing.

13. Regarding the sound transducer carriers, gloves, finger strap rings, finger caps, foot straps, heel and elbow sound transducer carriers; and the materials used in making them can vary in thickness, texture, elasticity, color, size, and other parameters.

14. Many different kinds of sound transducers and their sizes can be used (piezo films, piezo transducers, FSRs, tactile switches, etc.) in any orientation, permutation, and combinations of sensors, limbs, mounting methods, etc.

15. Flex sensors, gyroscopes, and accelerometers may be affixed onto any sensor support in any combination with the other sound transducer(s) to create more complex sound effects.

16. The sensor caps for the front part of the foot, like a front half of the sock that is carrying sound transducers of all kinds, like a piezo sensor, FSRs, and even gyroscopes and accelerometers may be used. Amplifying the front part of the foot pressure switch with one or more sensors of different kinds can be achieved in this manner.

17. The system may also be adapted for dancers. The whole foot may be covered with sound transducers and sensors, like a sock or mitten (not shown) which would be used by the dancers for contemporary fad craze dances such as break dancing, moonwalk, hip-hop, achy-breaky, and the like.

18. A different limb may be used than illustrated in various embodiments to create the same music. Almost any limb can be used for any music or dance, especially for the latest fad or craze dances.

19. Analogous to stretching a drum skin, applying pressure can be done with base of a palm instead of elbow. It can be done with the FSR or a pressure sensor placed at the base of the palm.

20. Likewise the sound transducers may be mounted on their carrier at any place and in any number in any orientation.

21. A small tactile switch between the thumb and index finger, or any sound transducer at any position on the carrier, may be used.

22. Female and male mono and stereo jacks may be used in any permutation and combination in any mating sizes.

23. Likewise cables of any type may be used in the same mix-and match-manner, so long as they can transfer the signal, whether mono or stereo. Any size is possible but preferably the cables should be as thin and light.

24. Any wireless connection may be employed as long as it transmits and receives the signal or the information. To provide even greater mobility wireless, mobile phone, or smart phone interfaces may be employed.

25. The drum module does not have to be a standalone but can be a sound module, midi equipment, midi sequencer connected to the appropriate equipment with software and sound banks.

26. One can play the piano or any other instruments using wearable drum triggers with the computer along with midi interface instead of standalone drum module (or even with a drum module).

27. A midi interface box may be mounted onto or near to each of the drum trigger carriers, and further connected to the computer, which may be portable, non portable, or a mobile phone computer, as long as it communicates with the carrier.

28. The eye-and-hook fasteners for the leg and hand straps and band loops can be made from any kind of material or tissue.

29. The connective bracelet material, design, and housing in may be varied.

30. Any appropriate material, cloth, tissue, or polymer, can be used.

31. Any wireless equipment device may optionally be backed up by its own power source, battery, etc.

32. A piezo transducer or some other sound transducer may be connected to the proper electronic device with a wireless transmitter (that runs on batteries) to transmit the signal or the information to the wireless receiver, which may be a part of a drum module or some other sound module or other appropriate musical equipment.

33. Hybrid wired and wireless environments may be employed.

34. Upscale and downscale embodiments may be designed, manufactured, and marketed.

35. Other changes, such as aesthetics and substitution of newer materials as they become available, which substantially perform the same function in substantially the same manner with substantially the same result, may be made.

Therefore the foregoing is considered as illustrative only of the principles of operation of the various embodiments. It is therefore contemplated that the appended claim(s) cover any modifications, embodiments as fall within the true scope of this embodiments shown and discussed.

The invention claimed is:

1. A process for creating live music in real time without the use of a musical instrument, comprising:

(a) providing a pressure sensor and a tactile sensor, said pressure sensor being mounted by mounting means on the outside of said thumb and said tactile sensor being mounted by mounting means on the underside of said thumb, said mounting means being selected from the group consisting of loops, bands, caps, films, gloves, and mittens, (b) interfacing said pressure sensor and said tactile sensor with an electronics and music module that has an output, (c) storing the sound of a percussion instrument in said electronics and music module, (d) interfacing said output of said electronics and music module to an audio output device, and (e) creating a choke effect by first producing said percussion instrument sound by actuating said pressure sensor and then choking said percussion instrument sound by actuating said tactile sensor.

2. The process of creating live music in real time without the use of a musical instrument of claim 1 wherein said cymbal choke effect is created by actuating said pressure sensor with momentary impact of said outside of said thumb against any planar hard surface to produce said cymbal sound, and said sound of said cymbal is choked and snubbed by making said fist such that said tactile sensor is actuated as it is pushed against said index finger of said fist.

3. A wearable trigger electronic music system for producing a cymbal choke effect, comprising:

a pressure sensor with mounting means for mounting said pressure sensor on the outside of a wearer's thumb, and a tactile sensor with mounting means for mounting said tactile sensor on the underside of said thumb, a sound module connected to said pressure sensor and said tactile sensor, said sound module containing a stored sound of a cymbal, and an output device connected to said sound module, whereby when said wearer activates said pressure sensor, said sound module and said output device produce said stored sound of said cymbal, and when said wearer activates said tactile sensor, said sound module and said output device produce said cymbal choke effect.

4. The wearable trigger electronic music system for producing a cymbal choke effect of claim 3, further including a planar hard surface, whereby said cymbal choke effect can be created by actuating said pressure sensor with momentary impact of said outside of said thumb against said planar hard surface to produce said cymbal sound, and said sound of said cymbal can be choked and snubbed by making said fist such that said tactile sensor is actuated as it is pushed against said index finger of said fist.

5. A wearable trigger electronic percussion music system, comprising:

ring means, worn on a plurality of fingers of a musician's hand, for electronically generating signals representing a plurality of musical sounds, including the sounds of a plurality of hand percussion instruments, said ring means comprising a plurality rings containing pressure sensors for mounting on said fingers of said musician's hand, an electronic processor for reproducing the sounds of said plurality of musical instruments in response to said signals representing said plurality of musical sounds, a communications interface for transmitting electric signals from said pressure sensors to said electronic processor, whereby said musical sounds are generated by said electronic processor when said a plurality rings containing said pressure sensors are activated.

6. The wearable trigger electronic percussion music system of claim 5, further including band means for electronically generating a signal representing a sound of a hand percussion instrument, said band means comprising a band containing a percussion sensor for encircling a palm of said musician's hand, said electronic processor arranged to also reproduce the sound of said hand percussion instrument in response to said signal from said band means, said communications interface arranged to separately transmit electric signals from said pressure sensors and said percussion sensor to said electronic processor, whereby said musical sounds are generated by said electronic processor when said pressure sensors or said percussion sensor are activated.

7. The wearable trigger electronic percussion music system of claim 6 wherein said percussion sensor is arranged to generate a signal representative of a bass signal.

8. The wearable trigger electronic percussion music system of claim 6 wherein said pressure sensors and said percussion sensor comprise identical sensors.

9. The wearable trigger electronic percussion music system of claim 5, further including a hard surface, whereby said musician can separately activate said pressure sensors by striking said surface with an open, flat hand held in a position for striking a hand percussion instrument.

10. The wearable trigger electronic percussion music system of claim 5 wherein said communications interface comprises a wireless interface.

* * * * *

UNITED STATES PATENT AND TRADEMARK OFFICE

CERTIFICATE OF CORRECTION

PATENT NO. : 8,362,350 B2
APPLICATION NO. : 12/959829
DATED : January 29, 2013
INVENTOR(S) : Neven Kockovic It is certified that error appears in the above-identified patent and that said Letters Patent is hereby corrected as shown below:

In the Specifications

Col. 6, line 26, change “first” to --fist--.

Signed and Sealed this
Twenty-eighth Day of May, 2013

Teresa Stanek Rea
*Acting Director of the United States Patent and Trademark Office*